US009646799B1

(12) United States Patent
Kim

(10) Patent No.: US 9,646,799 B1
(45) Date of Patent: May 9, 2017

(54) APPARATUS FOR SEALING ARC-TUBE

(71) Applicant: KUMHO ELECTRIC, INC., Seoul (KR)

(72) Inventor: Min Su Kim, Gyeonggi-do (KR)

(73) Assignee: KUMHO ELECTRIC, INC., Seoul (KR)

( * ) Notice: Subject to any disclaimer, the term of this patent is extended or adjusted under 35 U.S.C. 154(b) by 0 days.

(21) Appl. No.: 14/996,420

(22) Filed: Jan. 15, 2016

(51) Int. Cl.
*H01J 9/32* (2006.01)
*H01J 9/26* (2006.01)

(52) U.S. Cl.
CPC ..... *H01J 9/323* (2013.01); *H01J 9/266* (2013.01)

(58) Field of Classification Search
CPC .... H01J 9/32; H01J 9/323; H01J 9/266; H01J 9/265
See application file for complete search history.

(56) References Cited

U.S. PATENT DOCUMENTS 2,391,572 A * 12/1945 Herzog ..... H01J 9/32 141/66

FOREIGN PATENT DOCUMENTS

| | | | |
|---|---|---|---|
| JP | 2005-093165 | A | 4/2005 |
| JP | 2008-163591 | A | 7/2008 |
| KR | 10-2004-0004659 | A | 1/2004 |
| KR | 10-0864283 | B1 | 10/2008 |
| KR | 10-2010-0057755 | A | 6/2010 |
| KR | 10-1298113 | B1 | 8/2013 |

* cited by examiner

*Primary Examiner* — Anne Hines
(74) *Attorney, Agent, or Firm* — Rabin & Berdo, P.C.

(57) ABSTRACT

Provided is an apparatus for sealing an arc-tube including a jig body including an electrode pin hole into which an end part of the electrode pin inserted into a bypass tube part of the arc-tube is inserted and a connection path connected with the electrode pin hole; and a pressurizing means inserted into the connection path to pressurize and fix the electrode pin positioned at the electrode pin hole. Therefore, the apparatus for sealing an arc-tube can more easily and stably fix the electrode pin during a sealing process.

8 Claims, 9 Drawing Sheets

APPARATUS FOR SEALING ARC-TUBE

BACKGROUND

1. Field of the Invention

The present invention relates to an apparatus for sealing an arc-tube, and more specifically, to an apparatus for sealing an arc-tube including a sealing jig for sealing an upper bypass tube of the arc-tube.

2. Discussion of Related Art

Generally, a high intensity discharge lamp (HID lamp) is provided with two electrodes for applying a high pressure to an inside of a sealed arc-tube. A predetermined filling material (for example, a halide, mercury, argon, neon, sodium, or a noble gas, etc.) is ionized by an electric arc passing between the two electrodes, so as to be excited so that emitted light with a spectral energy distribution is generated.

The arc-tube is made of quartz or glass. However, recently, a use of a ceramic, such as alumina, as a material of the arc-tube has increased to satisfy a demand of high efficiency. Bypass tube parts are provided at both sides of the arc-tube, and gas is charged through the bypass tube parts. Electrode pins are inserted into the bypass tube parts. In this case, when the electrode pins are inserted into the bypass tube parts, the bypass tube parts are heated up to a high temperature (for example, 1600° C.) to seal the ceramic arc-tube.

At this time, it is important for the electrode pins to be inserted into the bypass tube parts so as not to be moved. This is because a distance between the two electrode pins arranged at both bypass tube parts of the arc-tube has an influence on the performance (brightness) of the high intensity discharge lamp. During the sealing process, when the electrode pin slips down or shakes, the distance between the two electrode pins becomes different from a designed distance. Therefore, there is a problem in which the performance of a product may be changed.

(Patent Document 1) Korean Laid-open Patent Application No. 2004-0004659 (Published on Jan. 13, 2004)

SUMMARY OF THE INVENTION

The present invention is directed to providing an apparatus for sealing an arc-tube capable of stably fixing or unfixing electrode pins inserted into an arc-tube during a process of sealing the arc-tube.

The scope of the present invention is not limited to the above-described objects, and other unmentioned objects may be clearly understood by those skilled in the art from the following descriptions.

One aspect of the present invention provides an apparatus for sealing an arc-tube including: a jig body including an electrode pin hole into which an end part of an electrode pin inserted into a bypass tube part of an arc-tube is inserted and a connection path connected to the electrode pin hole; and a pressurizing means inserted into the connection path to pressurize and fix the electrode pin positioned at the electrode pin hole.

The connection path may have a thread formed on an inner wall thereof, and the pressurizing means may be screwed to the connection path.

The connection path may include a first hole connected with the outside and a second hole in communication with the first hole and the electrode pin hole.

The first hole may be vertically formed and the second hole may be horizontally formed.

The pressurizing means may include an adjustable bolt screwed to the connection path and a fixing unit arranged to be movable in the connection path.

The adjustable bolt may be formed at an end part and include a push area including an inclined first contact surface, and the fixing unit may include a receiving area including a second contact surface which contacts the first contact surface.

The fixing unit may include a pressurizing area configured to pressurize the electrode pin.

The pressurizing area may be curved.

The fixing unit may be spherical.

A plurality of connection paths may be formed at regular intervals with respect to a vertical direction.

The connection paths may include a first hole connected with the outside and second holes in communication with the first hole and the electrode pin hole, wherein the second holes may be formed at regular intervals with respect to a vertical direction.

The jig body may include an accommodation space for including the arc-tube therein.

The jig body may be installed to fix an upper part of the arc-tube.

According to an embodiment of the present invention, a connection path, in communication with an electrode pin hole into which an electrode pin is inserted, is provided in a jig body installed on an upper part of the arc-tube, and the electrode pin is fixed or unfixed through a pressurizing means inserted into the connection path. Therefore, the electrode pin can be more easily and stably fixed during a sealing process.

According to the embodiment of the present invention, a plurality of connection paths are arranged in a length direction of the electrode pin and any one of the connection paths is selected and coupled to a pressurizing means. Therefore, a process of sealing arc-tubes of various sizes can be performed.

According to the embodiment of the present invention, in consideration of a configuration in which a coil is arranged around the jig body, a first hole of the connection path coupled with the pressurizing means is vertically formed. Therefore, an effect of a high frequency on the pressurizing means at the time of induction heating can be minimized.

BRIEF DESCRIPTION OF THE DRAWINGS

The above and other objects, features and advantages of the present invention will become more apparent to those of ordinary skill in the art by describing in detail exemplary embodiments thereof with reference to the attached drawings, in which.

DETAILED DESCRIPTION OF EXEMPLARY EMBODIMENTS

Purposes, specific advantages, and novel features of the present invention will be made clear from exemplary embodiments and the following detailed descriptions in connection with the accompanying drawings. Terms and words used in this specification and claims should not be interpreted as limited to commonly used meanings or meanings in dictionaries and should be interpreted with meanings and concepts which are consistent with the technological scope of the invention based on the principle that the inventors have appropriately defined meanings of terms in order to describe the invention in the best way. In descriptions of the invention, when detailed descriptions of related well-known technology are deemed to unnecessarily obscure the gist of the invention, they will be omitted.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

The terminology used herein is for the purpose of describing particular embodiments only and is not intended to be limiting of the invention. As used herein, the singular forms "a," and "an" are intended to include the plural forms as well, unless the context clearly indicates otherwise. It will be further understood that the terms "comprise," "comprising," "include" and/or "including," when used herein, specify the presence of stated features, integers, steps, operations, elements, and/or components, but do not preclude the presence or addition of one or more other features, integers, steps, operations, elements, components, and/or groups thereof.

Figure 1:
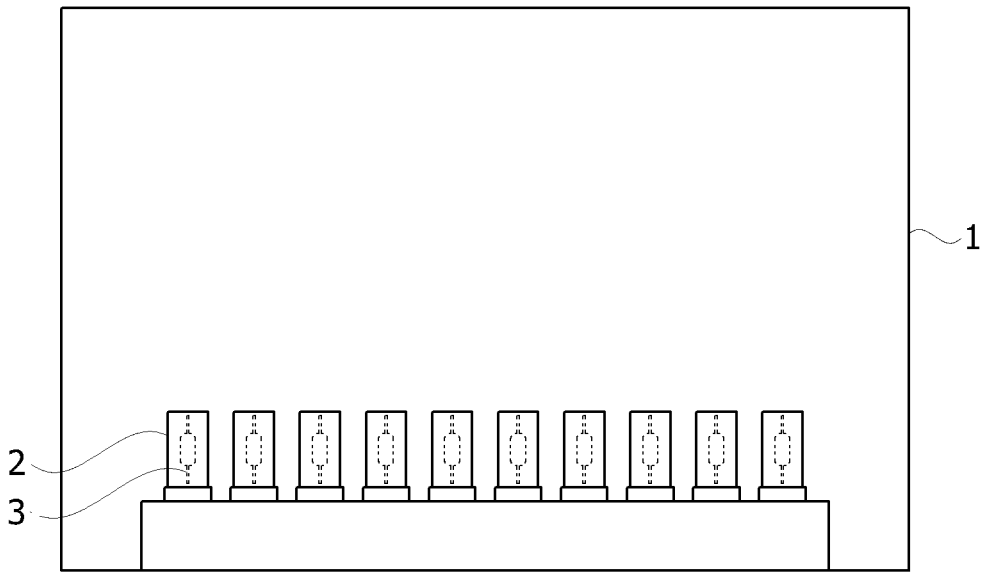
FIG. 1 is a view illustrating a glove box.

FIG. 1 is a view illustrating a glove box, and FIGS. 2 to 5 are views illustrating a process of manufacturing an arc-tube.

As illustrated in FIG. 1, an arc-tube 3 is fixed in a sealing jig 2 arranged in a glove box 1, and thus a manufacturing process proceeds.

An entire manufacturing process of the arc-tube is as follows.

Figure 2:
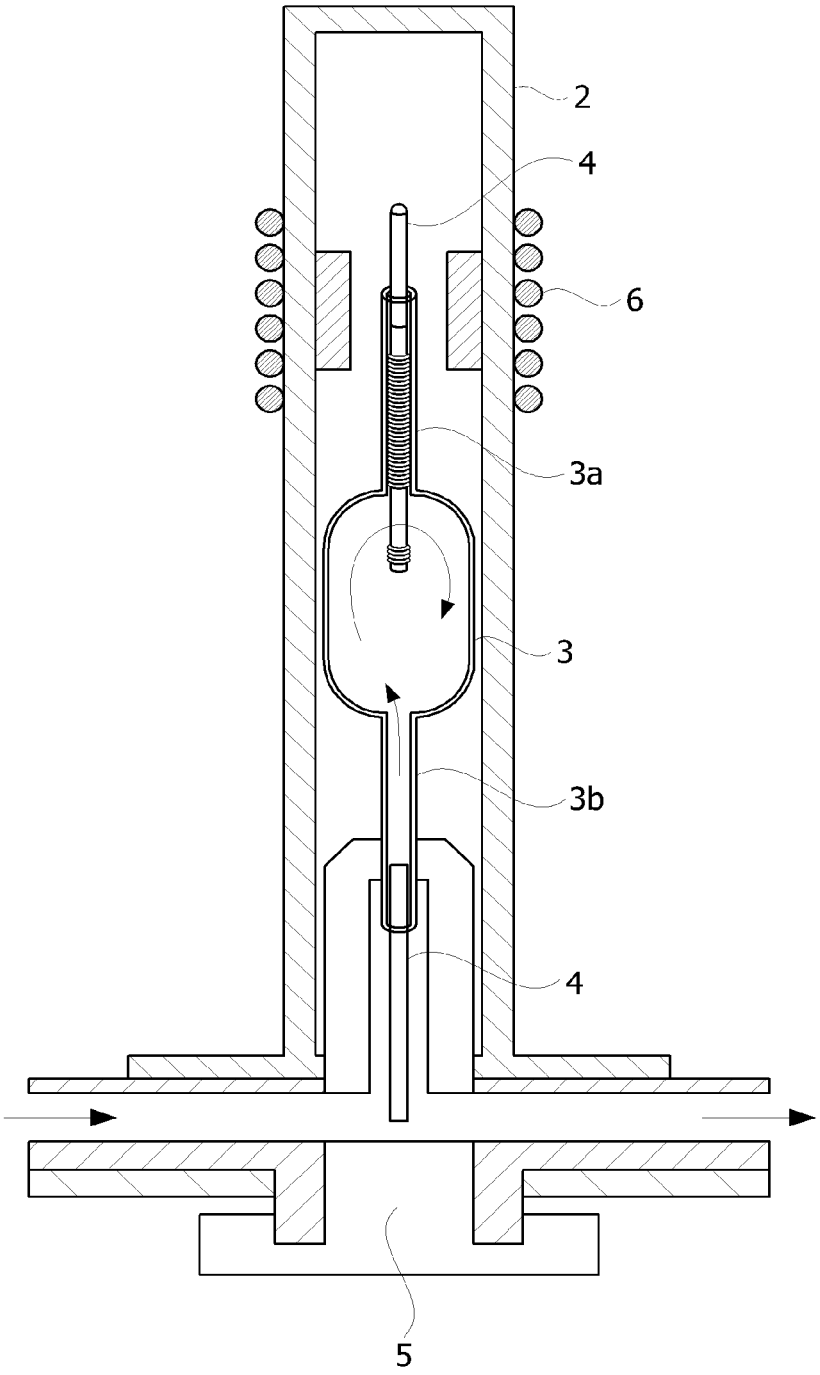
FIGS. 2 to 5 are views illustrating a process of manufacturing an arc-tube.

Referring to FIG. 2, first, a first sealing for an upper part of the arc-tube 3 may proceed. While a lower part of the arc-tube 3 is seated on a jig 5, a sealing jig 2 is mounted on an upper part of the arc-tube 3. A high frequency coil 6 is arranged around the sealing jig 2. When an electrode pin 4 is inserted into an upper bypass tube part 3*a* of the arc-tube 3 and the high frequency coil 6 is heated, the first sealing proceeds. The electrode pin 4 is inserted into a frit ring (4*a* in FIG. 4) and the frit ring 4*a* is melted due to induction heating, and thus a first sealing between the upper bypass tube part 3*a* of the arc-tube 3 and the electrode pin 4 is performed. A cooling process is performed for predetermined time after the first sealing.

After the completion of the first sealing, the arc-tube 3 is filled with gas, such as nitrogen, through a lower bypass tube part 3*b* of the arc-tube 3.

Figure 3:
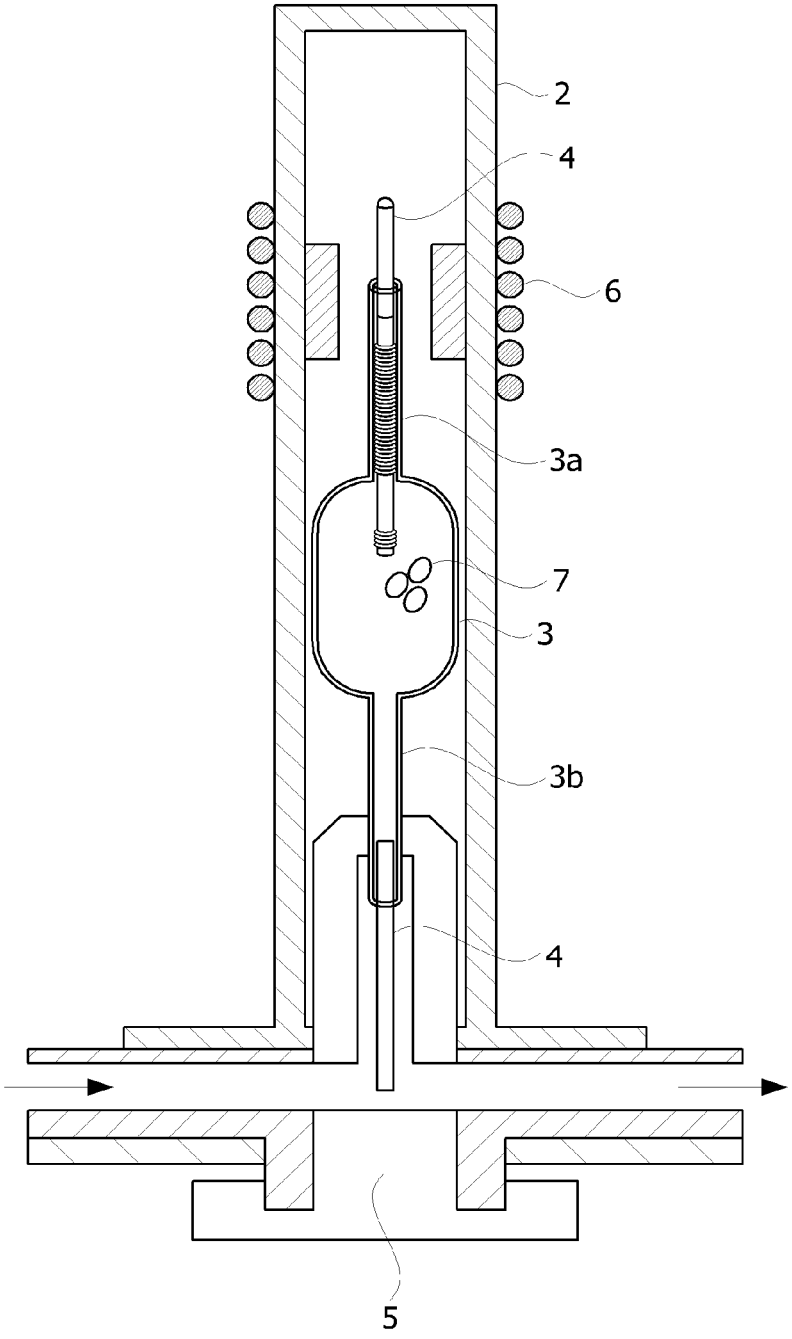

Referring to FIG. 3, subsequently, a metal halide 7 and mercury may be supplied into the arc-tube 3. The metal halide 7 is a material for emitting a predetermined color of a lamp by generating visible rays with radiant heat generated by separation of halide-based elements (sodium, thallium, sulfur, etc.).

Figure 4:
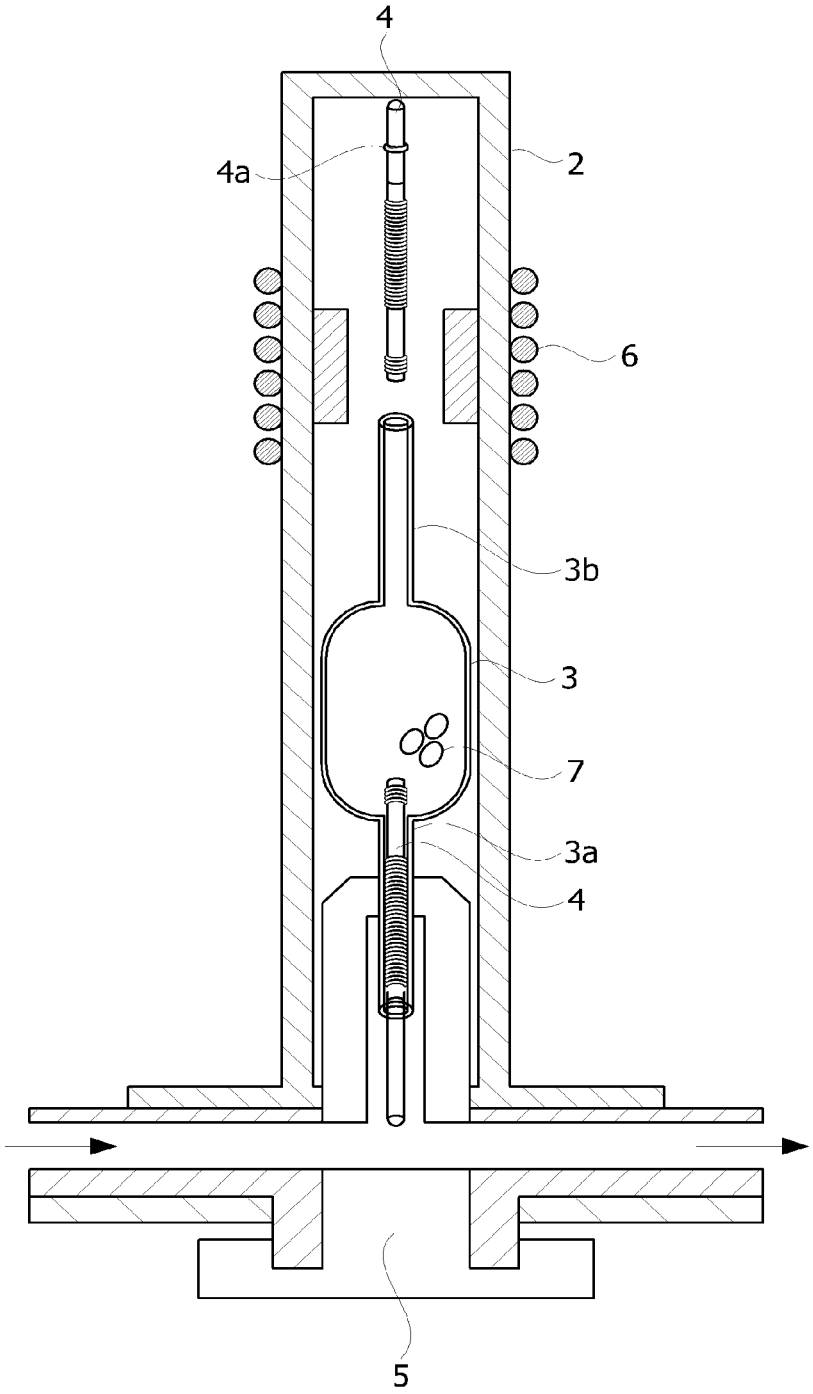
Figure 5:
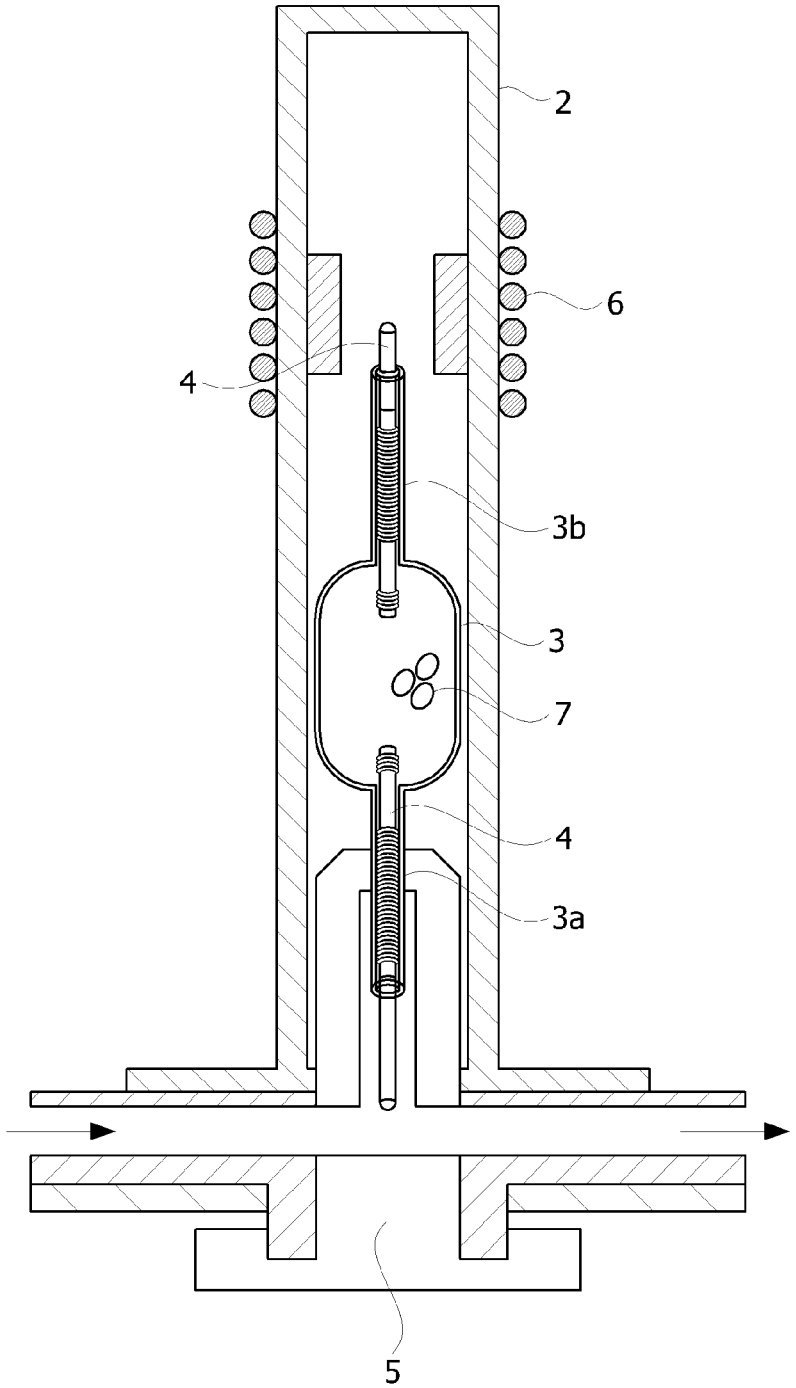

Subsequently, as shown in FIG. 4, through an exhaustion process, a second sealing for the lower bypass tube part 3*b* of the arc-tube 3 proceeds as shown in FIG. 5.

The apparatus for sealing an arc-tube according to the exemplary embodiment of the present invention, as shown in FIG. 2, is a device used in a process of sealing the upper bypass tube part 3*a* of the arc-tube 3.

Hereinafter, the apparatus for sealing an arc-tube according to the exemplary embodiment of the present invention will be described in detail with reference to the accompanying drawings.

Figure 6:
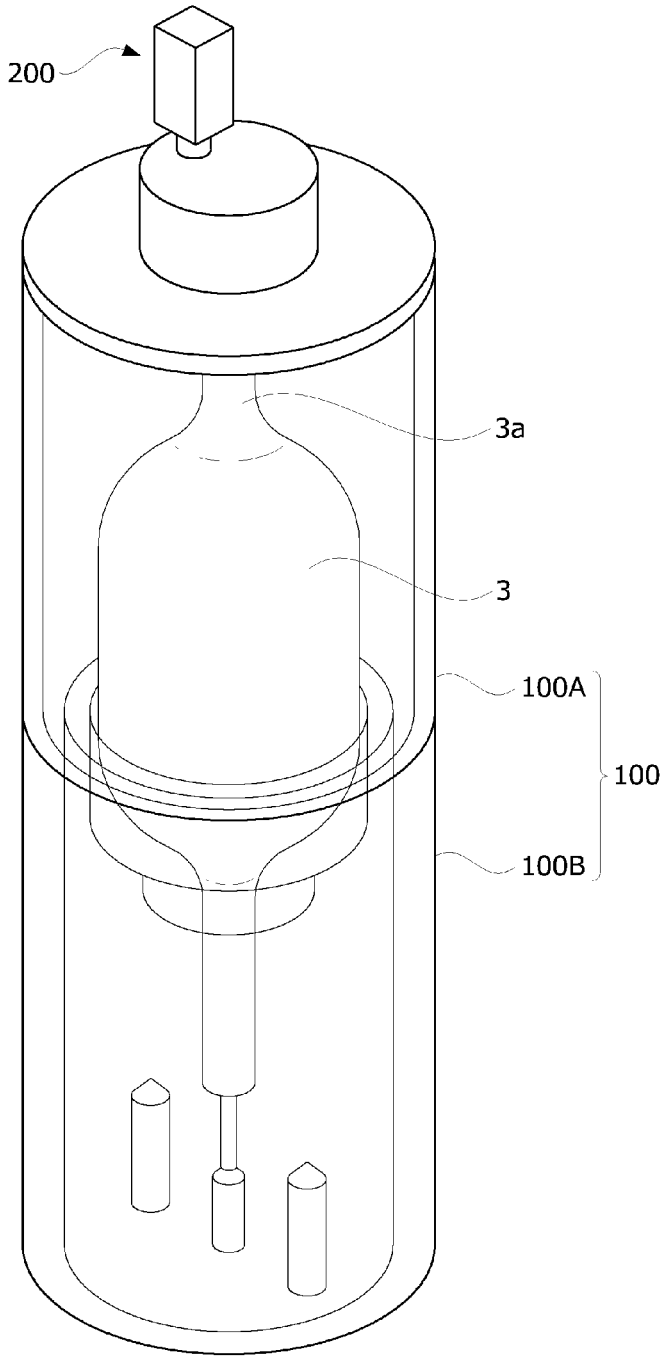
FIG. 6 is a view illustrating an apparatus for sealing an arc-tube according to an exemplary embodiment of the present invention.

FIG. 6 is a view illustrating an apparatus for sealing an arc-tube according to the exemplary embodiment of the present invention. In FIG. 6, only main features are clearly illustrated to conceptually and clearly understand the present invention. Accordingly, as a result, the drawings may be variously modified and may not be significantly limited to the specific forms illustrated in the drawings.

Referring to FIG. 6, the apparatus for sealing an arc-tube according to the embodiment of the present invention may include a jig body 100 and a pressurizing means 200.

The jig body 100, which is a device for supporting the arc-tube 3 by including the arc-tube 3 therein, is used in a comprehensive concept and includes not only a lower jig body 100B for supporting a lower part of the arc-tube 3 but also a upper jig body 100A for supporting an upper part of the arc-tube 3 to perform a sealing process of the upper bypass tube part 3*a* of the arc-tube 3.

In the description of the present invention, the jig body 100 is described as a device for performing a process of sealing the upper bypass tube part 3*a* of the arc-tube 3, but the present invention is not limited thereto.

Figure 7:
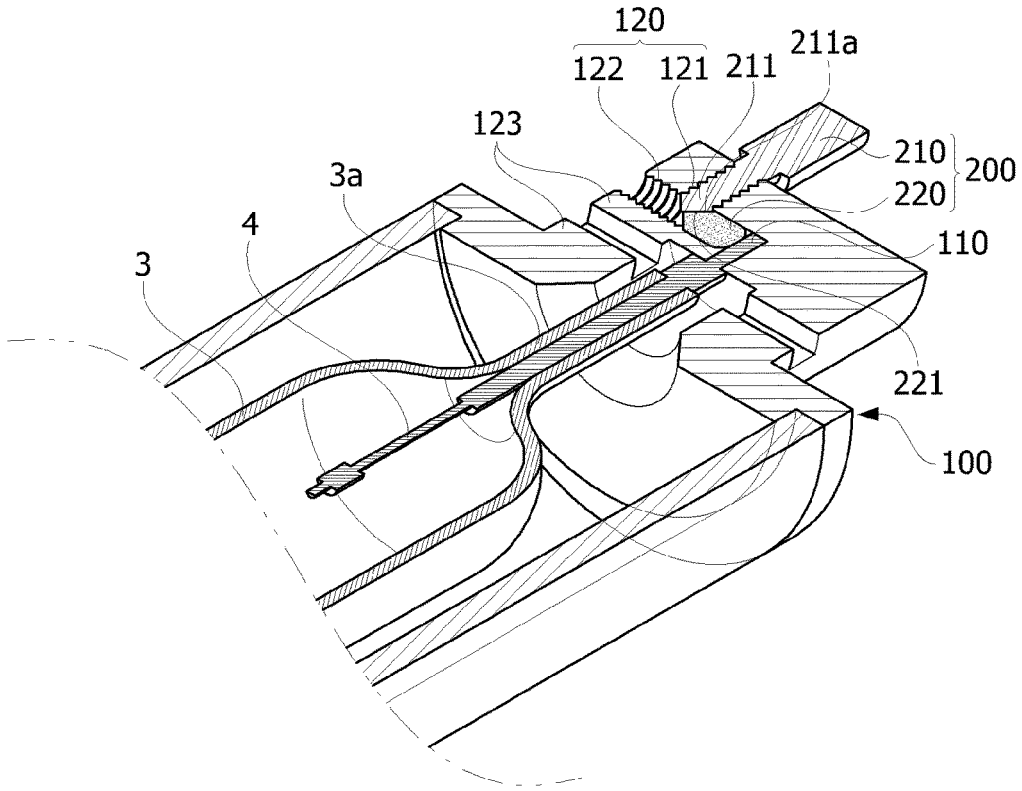
FIG. 7 is a view illustrating a jig body and a pressurizing means.

FIG. 7 is a view illustrating the jig body and the pressurizing means.

Referring to FIGS. 6 and 7, the jig body 100 may include an electrode pin hole 110 and a connection path 120.

The electrode pin hole 110 into which an upper end part of the electrode pin 4 inserted into the upper bypass tube part 3*a* of the arc-tube 3 is inserted may be formed to be long in a vertical direction so that an upper end of the electrode pin 4 can be inserted. The electrode pin hole 110 may be formed in a central area of a ceiling in the jig body 100.

The connection path 120 is a device for guiding the pressurizing means 200 to the electrode pin 4 inserted into the electrode pin hole 110. The connection path 120 is in communication with the electrode pin hole 110. A screw thread may be formed inside the connection path 120, such that the pressurizing means 200 is screwed thereto. A size of the connection path 120 may be appropriately designed in consideration of a size of the pressurizing means 200.

In the embodiment, the connection path 120 may include a first hole 121 connected with the outside and a second hole 122 in communication with the first hole 121 and the electrode pin hole 110.

The first hole 121 into which the pressurizing means 200 is directly screwed may be vertically formed starting from an upper end of the jig body 100.

The second hole 122 may communicate with the first hole 121 and the electrode pin hole 110 and may be horizontally arranged. A screw thread may also be formed in a partial area of the second hole 122.

The pressurizing means 200 is inserted into the connection path 120, and plays a role of pressurizing and fixing the electrode pin 4 inserted into the electrode pin hole 110. The pressurizing means 200 may include an adjustable bolt 210 and a fixing unit 220.

The adjustable bolt 210 is screwed into the connection path 120 to play a role in moving the fixing unit 220.

Specifically, the adjustable bolt 210 is fastened into the first hole 121 to be moved in a vertical direction by a rotation operation.

The fixing unit 220 serves to directly fix the electrode pin 4 in conjunction with a movement of the adjustable bolt 210. The fixing unit 220 may be arranged in the second hole 122.

A specific configuration of converting the vertical movement of the adjustable bolt 210 into a lateral movement of the fixing unit 220 may be as follows.

First, a push area 211 may be formed at an end part of the adjustable bolt 210. The push area 211 may include an inclined first contact surface 211*a*. The first contact surface 211*a* is in contact with a receiving area 221 of the fixing unit 220 to play a role in pushing the fixing unit 220 toward the electrode pin hole 110. As an example of the push area 211, the push area 211 may have a conical front end part.

The receiving area of the fixing unit 220 may also have a conical end part to correspond to the push area 211.

As a result, when the adjustable bolt 210 moves downward along the first hole 121 by a rotation operation of the adjustable bolt 210, the push area 211 is in contact with the receiving area 221 of the fixing unit 220 to move the fixing unit 220 toward the electrode pin hole 110.

Since the fixing unit 220 is pushed toward the electrode pin hole 110 to directly pressurize an upper end of the electrode pin 4, the electrode pin 4 can be prevented from slipping down and shaking during a sealing process.

A pressurizing area that pressurizes the electrode pin 4 may be formed on the opposite side of the fixing unit 220 on which the receiving area 221 is formed, and the pressurizing area may be curved. In the drawings, the fixing unit 220 has a long block shape, but may be spherical.

A configuration of vertically coupling the adjustable bolt 210 to an upper end of the jig body 100 and moving the adjustable bolt 210 may minimize an effect of a high frequency on the adjustable bolt 210 when considering a position of the high frequency coil surrounding the jig body 100 to perform the sealing process.

The user can easily fix or unfix the electrode pin 4 by only a rotation operation of the adjustable bolt 210 when the electrode pin 4 is arranged in the jig body 100.

Figure 8:
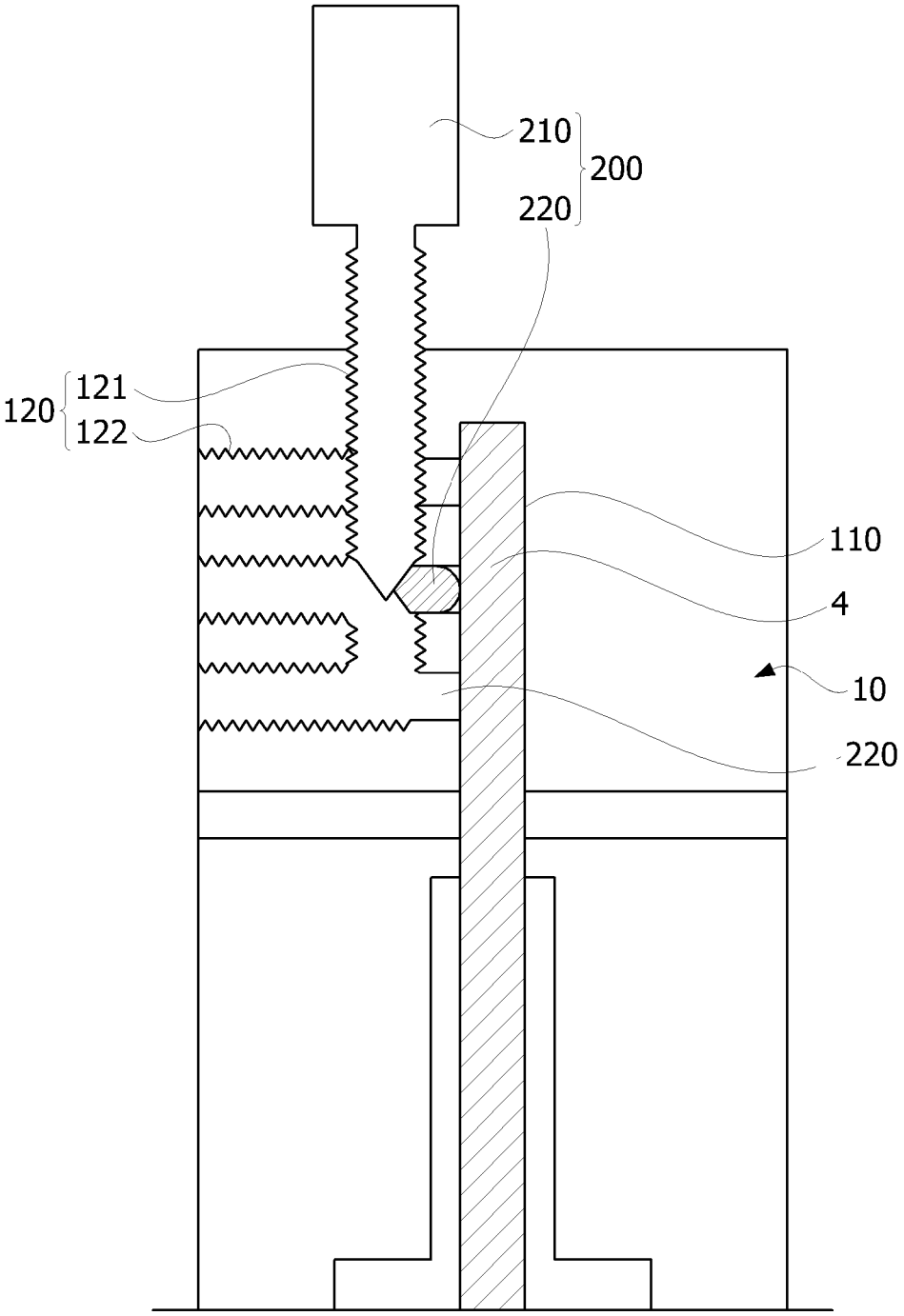
FIG. 8 is a view illustrating a plurality of connection paths arranged in a vertical direction at regular intervals.

FIG. 8 is a view illustrating a plurality of connection paths arranged in a vertical direction at regular intervals.

Referring to FIG. 8, as another embodiment of the apparatus for sealing an arc-tube according to the present invention, second holes 122 of the connection path 120 are horizontally formed in the jig body 100 in a plural number and are formed at regular intervals with respect to a vertical direction, thereby fixing the electrode pins of the arc-tube of various sizes.

That is, a length of the electrode pin 4 may be different depending on a size and specification of the arc-tube 3. Since the plurality of second holes 122 in which the fixing units 220 for pressurizing the electrode pins 4 may be arranged are formed in a vertical direction, a sealing process may be performed to correspond to various lengths of the electrode pins 4 of the arc-tube 3.

Meanwhile, since the first hole 121 is vertically formed, the first hole 121 may be formed to pass through from the uppermost second hole 122 to the lowermost second hole 122.

The user installs the fixing unit 220 in an appropriate second hole 122, corresponding to a position of the electrode pin 4, of the second holes 122 in consideration of a length of the electrode pin 4 of the arc-tube 3, and moves the adjustable bolt 210 down to the corresponding second hole 122, thereby fixing the electrode pin 4.

Figure 9:
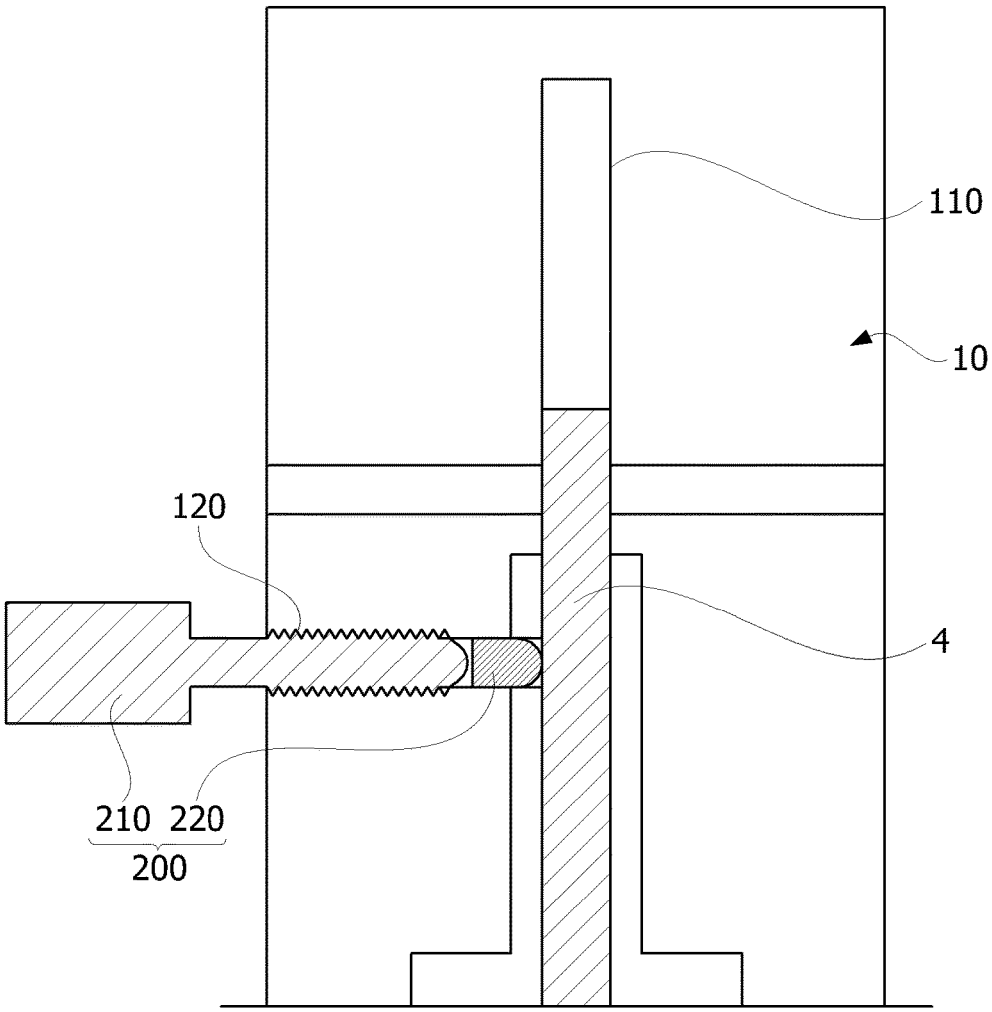
FIG. 9 is a view illustrating a pressurizing means inserted into the connection path in a horizontal direction.

FIG. 9 is a view illustrating a pressurizing means inserted into the connection path in a horizontal direction.

Referring to FIG. 9, as still another embodiment of the apparatus for sealing an arc-tube according to the present invention, the adjustable bolt 210 is directly coupled to the horizontally formed connection path 120 to pressurize the fixing unit 220 arranged in the connection path 120, thereby fixing the electrode pin 4. That is, a movement direction of the adjustable bolt 210 is formed to be the same as a movement direction of the fixing unit 220.

Hereinbefore, the apparatus for sealing an arc-tube according to the exemplary embodiment of the present invention has been described in detail with reference to accompanying drawings.

The above-described embodiments should be considered in a descriptive sense only and not for purposes of limitation. The scope of the present invention is defined not by the above-described detailed description but by the following appended claims, and encompasses all modifications and alterations derived from meanings, the scope and equivalents of the appended claims.

DESCRIPTION OF SYMBOLS

100: JIG BODY
110: ELECTRODE PIN HOLE
120: CONNECTION PATH
121: FIRST HOLE
122: SECOND HOLE
200: PRESSURIZING MEANS
210: ADJUSTABLE BOLT
211: PUSH AREA
211A: FIRST CONTACT SURFACE
220: FIXING UNIT
221: RECEIVING AREA

What is claimed is:

1. An apparatus for sealing an arc-tube, comprising:

a jig body including an electrode pin hole into which an end part of an electrode pin inserted into a bypass tube part of an arc-tube is inserted, and a connection path connected to the electrode pin hole; and a pressurizing means inserted into the connection path to pressurize and fix the electrode pin positioned at the electrode pin hole, wherein the connection path has a thread formed on an inner wall thereof, and the pressurizing means is screwed to the connection path, wherein the connection path comprises a first hole connected with the outside and a second hole in communication with the first hole and the electrode pin hole, wherein the first hole is vertically formed and the second hole is horizontally formed, wherein the pressurizing means comprises an adjustable bolt screwed to the connection path and a fixing unit arranged to be movable in the connection path, and wherein the adjustable bolt is formed at an end part of the pressurizing means and comprises a push area including an inclined first contact surface, and the fixing unit comprises a receiving area including a second contact surface which contacts the first contact surface.

2. The apparatus for sealing an arc-tube of claim 1, wherein the fixing unit further comprises a pressurizing area configured to pressurize the electrode pin.

3. The apparatus for sealing an arc-tube of claim 2, wherein the pressurizing area is curved.

4. The apparatus for sealing an arc-tube of claim 1, wherein a plurality of connection paths are formed at regular intervals with respect to a vertical direction.

5. The apparatus for sealing an arc-tube of claim 1, wherein the jig body comprises an accommodation space for including the arc-tube therein.

6. The apparatus for sealing an arc-tube of claim 5, wherein the jig body is installed to fix an upper part of the arc-tube.

7. A apparatus for sealing an arc-tube, comprising:

a jig body including an electrode pin hole into which an end part of an electrode pin inserted into a bypass tube part of an arc-tube is inserted, and a connection path connected to the electrode pin hole; and a pressurizing means inserted into the connection path to pressurize and fix the electrode pin positioned at the electrode pin hole, wherein the connection path has a thread formed on an inner wall thereof, and the pressurizing means is screwed to the connection path, wherein the connection path comprises a first hole connected with the outside and a second hole in communication with the first hole and the electrode pin hole, wherein the first hole is vertically formed and the second hole is horizontally formed, wherein the fixing unit further comprises a pressurizing area configured to pressurize the electrode pin, wherein the pressurizing area is curved, and wherein the fixing unit is spherical.

8. A apparatus for sealing an arc-tube, comprising:

a jig body including an electrode pin hole into which an end part of an electrode pin inserted into a bypass tube part of an arc-tube is inserted, and a plurality of connection paths connected to the electrode pin hole; and a pressurizing means inserted into one of the connection paths to pressurize and fix the electrode pin positioned at the electrode pin hole, wherein the connection paths comprise a first hole connected with the outside and second holes in communication with the first hole and the electrode pin hole, and wherein the second holes are formed at regular intervals with respect to a vertical direction.

* * * * *